United States Patent [19]

Gleim

[11] 4,211,633

[45] * Jul. 8, 1980

[54] SEPARATION OF ASPHALTIC MATERIALS FROM HEPTANE SOLUBLE COMPONENTS IN LIQUIFIED SOLID HYDROCARBONACEOUS EXTRACTS

[75] Inventor: William K. T. Gleim, Seattle, Wash.

[73] Assignee: Energy Modification, Inc., Gainesville, Fla.

[ * ] Notice: The portion of the term of this patent subsequent to May 22, 1996, has been disclaimed.

[21] Appl. No.: 22,818

[22] Filed: Mar. 22, 1979

Related U.S. Application Data

[63] Continuation-in-part of Ser. No. 873,115, Jan. 30, 1978, Pat. No. 4,155,833.

[51] Int. Cl.[2] ..... C10C 3/00; C10C 3/08

[52] U.S. Cl. ..... 208/45; 208/309

[58] Field of Search ..... 208/45, 309

[56] References Cited

U.S. PATENT DOCUMENTS

| | | | |
|---|---|---|---|
| 3,235,482 | 2/1966 | Knowles | 208/45 |
| 3,490,586 | 1/1970 | Jaisle | 208/45 |
| 4,155,833 | 5/1979 | Gleim | 208/45 |

*Primary Examiner*—Veronica O'Keefe

*Attorney, Agent, or Firm*—Philip T. Liggett

[57] ABSTRACT

A more efficient separation of asphaltic materials from the heptane soluble components in liquified coal and other liquified solid hydrocarbonaceous materials is accomplished by using a natural gasoline fraction, boiling in the range of from 200°-400° F., as a solvent extraction agent and then effecting a centrifugal separation at elevated temperatures and pressures. The resulting separated asphaltic materials will have far less heptane soluble material than the heretofore used procedures which involved the settling out of the asphaltenes in huge settling tanks.

6 Claims, 2 Drawing Figures

SEPARATION OF ASPHALTIC MATERIALS FROM HEPTANE SOLUBLE COMPONENTS IN LIQUIFIED SOLID HYDROCARBONACEOUS EXTRACTS

This application is a continuation-in-part of my presently filed application Ser. No. 873,115 filed Jan. 30, 1978, now U.S. Pat. No. 4,155,833.

This invention is directed to a more efficient procedure for separating heat labile asphaltic materials from the heptane soluble material in order to preclude obtaining undesirable high quantities of the heptane solubles in the asphaltic fraction.

More particularly, the present invention is directed to a procedure which utilizes a centrifugal action to separate the fractions of a mixture of asphaltic materials, solvent and heptane solubles. Typically, the less adulterated "true" heat labile or asphaltic type materials will be centrifuged out of the mixture at temperatures ranging from 100°-200° C., at a pressure of from 2 to about 10 atmospheres.

As a result, the present process will make for a better treatment of certain liquified coal extracts and other liquified hydrocarbonaceous extracts, as well as the residues from crude oil distillation by virtue of permitting relatively complete and economical conversion of the coal extracts or oils to the production of less, but better, asphaltic materials, while at the same time effecting the separation of greater quantities of the heptane soluble components that can be cracked or otherwise converted to valuable distillate. In another apsect, it is also especially desirable to provide a process which can treat residue materials to remove the heat labile asphaltic materials so that the resulting stream can be charged to a hydrodesulfurization unit without having excess coke forming fractions and metal residues to affect the catalysts of the desulfurizing units, while simultaneously effecting in such units a much higher degree of desulfurization.

BACKGROUND OF THE INVENTION

It is generally known that the use of straight vacuum residue for road asphalt produces a road cover of inferior quality from the standpoint of durability because the paraffin components of the vacuum residues are readily biologically degradable. In time the asphalt cover loses its coherence and becomes brittle. The same problems could occur with liquid coal extracts which also contain heat-sensitive materials called asphaltenes but which are not chemically the same as petroleum asphaltenes. In any event, various deasphalting processes have been developed in order to obtain a more paraffin-free asphaltic product. The deasphalting process, in general, consists of extracting the heptane solubles from the asphaltenes. The "asphaltenes" are defined as materials which are insoluble in pentane or heptane at ambient temperatures, but soluble in benzene. The asphaltene materials are also considered to be "heat labile," in that they coke readily at temperatures above about 700° F. Typically the solvents used in "deasphalting" operations to separate the heptane solubles from the asphaltenes are propane and mixtures of propane, butane and pentane.

It has, however, recently been determined that the various groups of compounds making up these mixtures called "asphaltenes" still contain up to 40% to 60% of material soluble in heptane at elevated temperatures.

This discovery came to light from a new analytical method designed to analyze recovered asphaltenes and reference may be made to: A.P.I. Research Project 60, Report No. 13, "Characterization of the Heavy Ends of Petroleum," July 1, 1972, to June 30, 1973. In essence, it appears that the high percentage (up to 60%) of microcrystalline waxes remains because they are soluble in heptane at its boiling point of about 100° C., while only soluble to a small extent at ambient temperatures. In the standard asphaltene test, where there is testing with pentane or heptane at ambient temperatures, the microcrystalline waxes are practically insoluble in the solvent and tend to simulate asphaltenes and wil to some degree co-precipitate with them.

By way of comprise, the new method of asphaltic component analysis demonstrates that the so-called asphaltenes, as determined by insolubility in heptane, actually consist of about 50% microcrystalline waxes, on the average, and about 50% true asphaltic material. In other words there is less "true" asphaltic material in crude oils than heretofore thought. It is to be emphasized that this asphaltic material recovered in the improved separation procedure will be less adulterated; and, as a result, not subjected to the rapid deterioration of the asphaltenes which contain up to 50% waxes. In addition, it is to be pointed out that a better separation of the waxes provides a greater yield of material suitable as a valuable source of distillate. Asphaltic materials cannot be cracked to distillate. Where they are left in distillate cuts, they mostly form gas and coke, causing difficulties in the refining operations. Actually, as heretofore noted, the presence of the heat labile materials prevents the total desulfurization of the residual fuels in the present-day catalytic hydrodesulfurization units. The commercial desulfurization of residual fuels containing asphaltenes achieves a reduction of the sulfur content to no better than 0.2% to 0.3% while the same residual fuel can be desulfurized to less than 0.01% sulfur provided the asphaltic materials are removed. Furthemore, catalyst life can be extended from one year to about eight years.

SUMMARY OF THE INVENTION

With regard to liquid coal extracts, as hereinbefore suggested, it is also to be recognized that they have large amounts of "asphaltenes," or what may be called "asphaltic materials," and the liquid products are heat-sensitive so as to make them difficult to refine because of coke formation, in the same manner as the bottoms of crude oil distillation which are high in asphaltenes. For convenience, the asphaltic materials, asphaltic precursors, etc., will be referred to as "asphaltic materials" to differentiate them from the asphaltenes.

Thus, it may be considered a principal object of the present invention to effect a separation procedure in connection with a liquid coal extract which results in separating out what may be referred to herein as the asphaltic materials free of heptane solubles in a typical resulting asphaltene fraction.

It is a further object of the present invention to use a centrifugal force separation procedure such that there is a more rapid and less cumbersome overall process as compared to the more conventional settling types of operations which require large volumes of solvent and huge settling tanks.

It has been noted that certain centrifugal separation operations have been used, or at least taught as being of advantage in connection with a crude before an atmospheric and vacuum distillation to remove a substantial portion of the wax content; however, it is not known that any prior work has been done with regard to the present process where the centrifugal separation is carried out in the presence of the solvent at elevated temperatures, i.e., in a range of from about 100° C. to about 200° C. and while the pressure is superatmospheric, i.e., up to about 10 atmospheres or more, depending upon mechanical aspects.

A still further object resides in providing a process resulting in charge stocks from liquid coal extracts, and the like, which can be utilized for introduction into a catalytic hydrodesulfurizer to in turn provide sulfur-free fuel oil or a stock that can be cracked to produce greater quantities of gasoline.

In one embodiment, the present invention provides an improved method for maximizing the separation of the heat labile fraction of asphaltic materials in a liquified solid hydrocarbonaceous extract which comprises the steps of:

(a) adding a solvent for the heptane solubles of said extract, (b) effecting a mixing of said solvent and said extract and providing a pressurized centrifuging action of the combined stream in a confined pressure-tight powered centrifuging zone at a temperature in the range of about 100° C. to about 200° C. while at an elevated pressure at least sufficient to maintain the solvent material in a liquid state, whereby to separate the heavier heat labile asphaltene fraction from the mixture, and (c) effecting the withdrawal of the asphaltic fraction from the centrifuging zone separate from and substantially free of the resulting mixture of liquified extract and solvent-soluble materials.

In another embodiment, the invention provides a method for obtaining an improved, more concentrated asphaltic material cut from a liquid coal extract, and the like, by adding a suitable solvent to such extract and effecting a mixing thereof followed by a centrifugal separation stage all carried out at an elevated temperature in the range of from about 100° C. to about 200° C., and at an elevated pressure of from about 2 to 10 atmospheres, and then affecting a recovery of the resulting asphaltic materials from the solvent and the heptane soluble materials.

In still other embodiments, a desired processing operation will effect the separation of the solvent fraction from the heptane solubles and provide for the recycling of at least a portion of such solvent fraction to provide for admixture with the liquid coal stream being introduced into the centrifugal separation zone.

In order to point out still further advantages resulting from the present invention, it should be noted that the presence of heptane solubles in an asphaltic residue can be detrimental in the same way that microcrystalline waxes in an asphalt component from a petroleum residue can make an inferior road cover material. There is the corollary aspect in that the presence of asphaltenes in oil, or in a liquified coal extract stream, can cause great difficulties in the refining operations. More specifically, while the asphaltic components cannot be easily cracked, as has herein before set forth, and will cause harmful coke formation, it is also to be again pointed out that the "asphaltic materials" have a high content of sulfur, oxygen, and nitrogen which will lead to rapid catalyst deactivation in catalytic cracking units.

Actually from the aspect of processing operations, it should be of considerable nationwide advantage if a more economical separation process is provided for both the coal and the oil industries so as to yield more distillate materials and less, but better, asphaltic materials.

It is not intended to limit the invention to any one source of coal or to any one type of liquid coal fraction. Also, the liquified coal extract may be derived from many of the various solvent extraction processes or coal "liquification" operations where there is a resulting hydrocarbonaceous liquid suitable for use as a substitute for petroleum liquids.

DESCRIPTION OF THE DRAWING

In order to better explain the present improved separation process, as well as assist in setting forth advantages there from, reference may be made to the accompanying drawing and the following description thereof.

Figure 1:
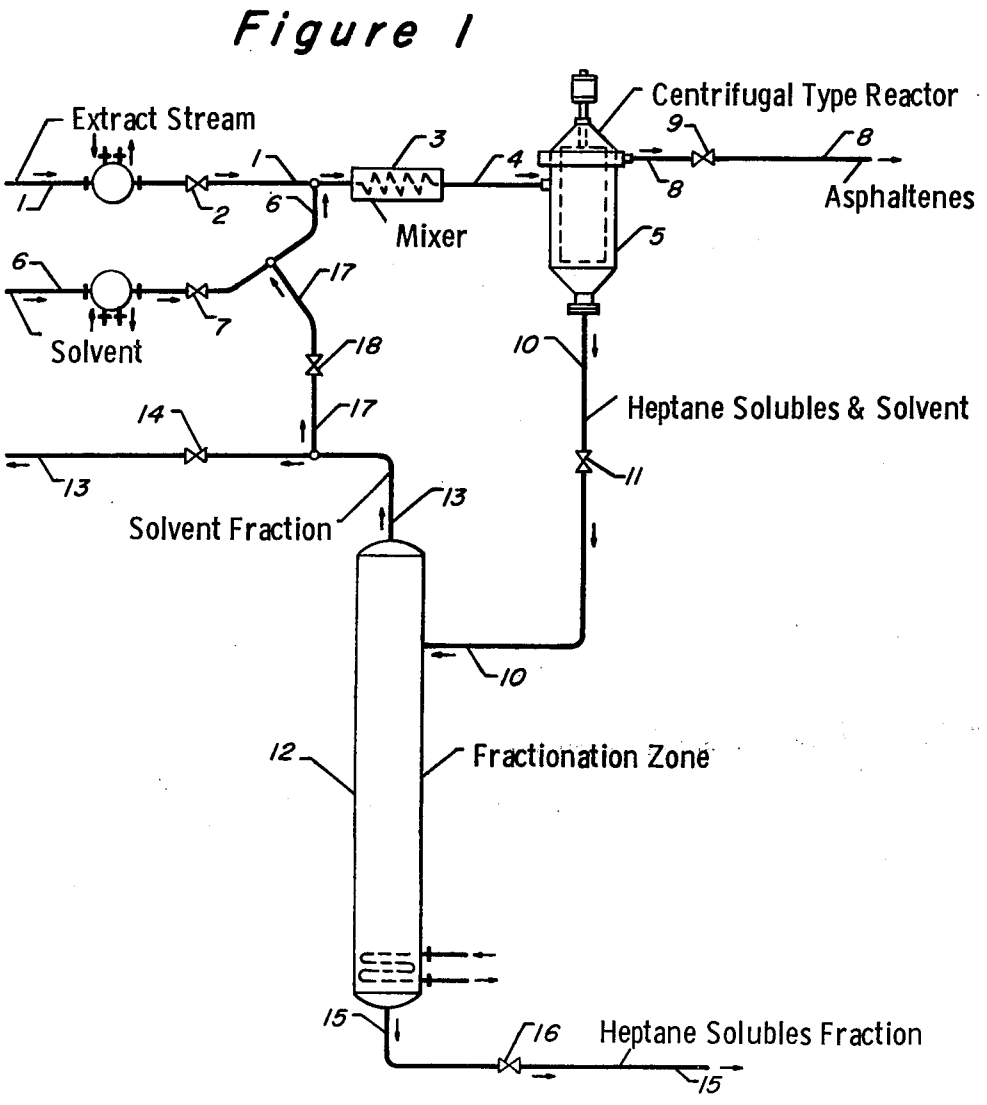
FIG. 1 is a diagrammatic drawing showing a process flow embodying the present invention.

Referring now particularly to FIG. 1 of the drawing, there is diagrammatically shown a charge line 1, with control valve 2, providing means to introduce an asphaltene-containing residue stream, (such as from equipment providing a treated liquified coal extract stream) into a premixing zone 3, and then through line 4 into a centrifuging type of reactor unit 5. In addition, there is also shown a line 6, with valve 7, connecting to the charge line 1 so as to provide for the mixing of a suitable solvent into the charge stream and into the mixer 3 and thence to the centrifuging reactor 5. In the standard deasphalting process the solvent stream as heretofore noted would typically comprise propane or a mixture of propane, butane and pentane so as to primarily effect the removal of the material (heptane solubles at ambient temperatures) from the residue stream. Actually, in the present process, the solvent may typically comprise a natural gasoline cut that should be available in most refineries with a boiling range of 50° C. to 200° C., a density of not more than about 0.75 and a vapor pressure of not more than about 10 atmospheres at a temperature of 200° C. The solvent should dissolve all the materials oil-soluble at elevated temperatures but not the oil-insoluble, colloidally dispersed material, namely the asphaltic components.

The mixing and centrifuging in the respective units 3 and 5 is carried out at temperatures ranging from 100° C. to 200° C. and at a pressure above atmospheric up to a pressure not exceeding about 10 atmospheres, or to the general limits of the centrifuge. Up until recent times suitable types of centrifuges were not available to effect the desired processing conditions. However, at the present time, a mechanical decanter type of unit which can operate at elevated pressures and temperatures is known to be available such as from the Escher-Wyss Co. of Switzerland and from the Kraus-Maffei Co. of West Germany.

The mixer unit 3 is indicated diagrammatically as a baffled static mixer; however, it is not intended to limit the present operation to the use of any one type of mixer since various types of units, including mechanically agitated mixers may well be used to advantage. In other instances, line mixing together with the mixing in the centrifugal reactor unit may be sufficient.

The centrifuge, operating under the proper conditions, will serve to discharge the heavier asphaltic component stream by way of an upper line 8, with valve 9, separate and apart from the solubles-solvent stream which, in this instance, is shown as being discharged from lower line 10, through valve 11, to a separation zone 12. The latter is shown as a fractionator type of unit providing for the overhead removal of a solvent fraction by way of line 13 with valve 14 and the bottoms withdrawal of a heptane-solubles fraction by way of line 15 and control valve 16.

In addition there is shown the provision of a line 17 from line 13 which will provide for the controlled recycle, by way of valve 18, of at least a portion of the solvent stream into line 6 and back to the mixing section of the overall processing unit. The indicated scheme is, of course, diagrammatic and variations in the equipment may well be incorporated, as for example, a plurality of separation-fractionator means may be used if desired, in lieu of the single vessel unit 12, in order to obtain the desired separation of the solvent stream. For simplicity, pumps, heaters, instruments, etc., are not shown in the drawing.

Figure 2:
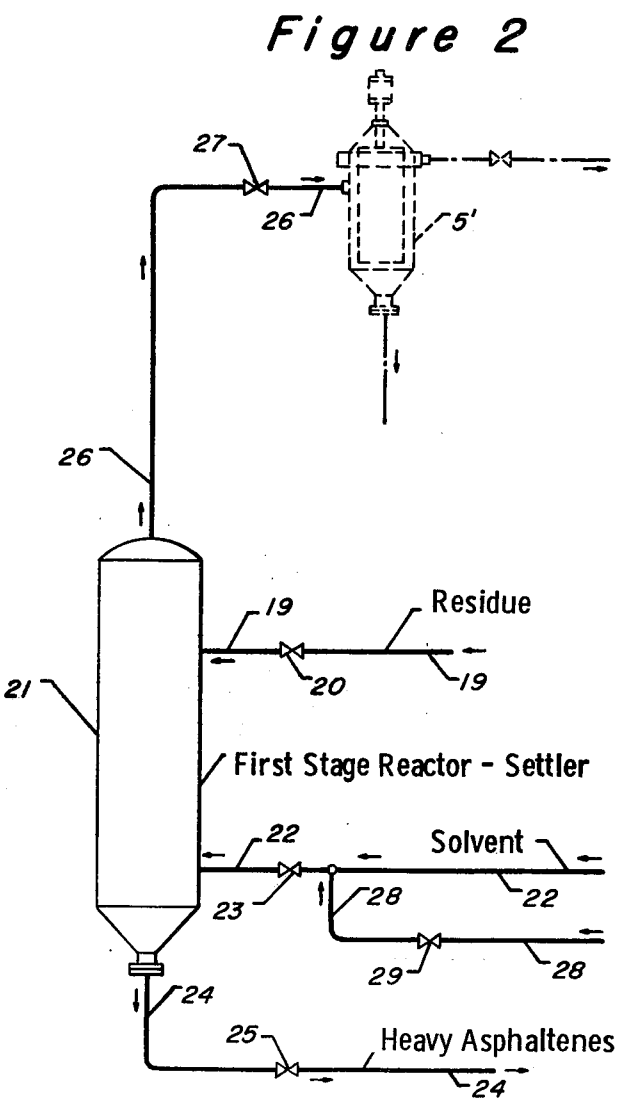
FIG. 2 is a modification of the process flow of FIG. 1 to the extent that an initial reactor-settler is utilized ahead of the centrifugal reactor.

As an alternative operation, as best shown in FIG. 2 of the drawing, there is indicated the introduction of the heated extract stream through line 19 and control valve 20 to a first stage reactor-setter 21. There is also shown, at a lower level, the introduction of the solvent stream by way of line 22 and valve 23. Preferably the tower 21 will have a diameter-to-height ratio of from about 1:5 to about 1:10.

The heaviest asphaltic materials will settle to the bottom of the reactor, where they can be withdrawn by way of line 24 and control valve 25. The lighter asphaltenes, suspended in the solvent are carried to the top of the reactor 21 and then the entire overhead stream would be carried by way of line 26 and valve 27 to a centrifuging reactor 5 to be processed in the same manner as the teachings of FIG. 1 of the drawing. Recycled solvent could also be added to line 22 from a line 28 and valve 29.

It is to be understood that the drawings are diagrammatic and that still other modifications may be utilized as to types of mixing, centrifuging, fractionating, etc., as well as arrangement of zones. All pumps, other valving, instrumentation, etc., as required by conventional refinery construction has also been eliminated from the drawing in order to simplify the presentation.

In this modified process it is again the function of the overall operation to remove the heat labile, coke forming, materials so that a better charge stock for fuel is made and/or a better separation is provided in obtaining improved road asphalts, etc.

In order to illustrate the advantages of the improved type of processing operation, the following examples are set forth to show the more desirable resulting product streams.

EXAMPLE I

In one test operation 200 grams of 100 mesh size Illinois #6 coal are introduced together with 200 grams of tetralin into a 1.8 liter rocking autoclave. After the introduction of hydrogen at 1500 p.s.i. the autoclave is closed and heated for 2 hours to 750° F. After cooling there is a resulting suspension consisting of a solution and 18% undissolved coal. The solution contains of the order of 29% heptane insolubles.

The total suspension is directly diluted with 3 volumes of a natural gasoline cut boiling between 150° F. and 300° F.

This suspension is then centrifuged at 300° F. with a powered mechanical decanter type centrifuge to provide a solids content consisting of undissolved coal and the heptane insolubles.

Typically, after distilling of both the natural gasoline and the tetraline, 50% of the initial coal is recovered as a heptane soluble material, solid at room temperature. This material can be desulfurized to provide less than 100 ppm sulfur by the standard desulfurization processes. Also, the heptane soluble material, when mixed with petroleum derived vacuum gas oil, can undergo in such a solution all the reactions commonly carried out with vacuum gas oil itself.

EXAMPLE II

In the heating and mixing of an Athabasca tar sand bitumen extract, which contains 12.8% asphaltenes, 1.4% clay and 270 ppm metals (primarily nickel and vanadium) with a solvent stream comprising only one volume of a natural gas liquid cut (boiling between 100° C. and 125° C.) at a temperature of the order of 170° C., while at the same time maintaining the mixture at an elevated pressure to keep the solvent liquid during a reaction period in a pressure tight centrifugal reactor of the mechanical decanter type described in Example I, there will be a resulting product stream where the asphaltenes will be only of the order of 7.0%, by the standard ASTM test method, while the metals will be about 90 ppm and the clay substantially all removed.

By the foregoing examples, it can be noted that the centrifuging operation will provide highly improved product streams while utilizing quite small amounts of solvent materials as compared to the older and conventional settling processes.

It is to be further noted that the present method of operation does not limit itself to merely using the typical "wax solvents" of $C_3$, $C_4$, and $C_5$, or mixtures thereof, but prefers hexane and heptane, or, as shown in the examples, may comprise natural gas cuts. The solvent will typically dissolve the heptane solubles content but only a minimum of the coke-forming asphaltenes type materials.

Also with further regard to the term "liquified coal extract" as used herein, there should be the encompassing of related hydrocarbonaceous products, or partially liquified products, as may be obtained from various types of coal, shale, peat, tar sands, etc., all of which are sometimes referred to as "black oils" and which contain significant quantities of the asphaltenic materials.

I claim as my invention:

1. An improved method for maximizing the separation of the heat labile fraction of asphaltic materials in a liquified solid hydrocarbonaceous extract, which comprises the steps of:

(a) adding a solvent having a boiling range of from about 50° C. to 200° C. for the heptane solubles of said extract, (b) effecting a mixing of said solvent and said extract and providing a pressurized centrifuging action of the combined stream in a confined pressure-tight powered centrifuging zone at a temperature in the range of about 100° C. to about 200° C. while at an elevated pressure at least sufficient to maintain the solvent material in a liquid state, whereby to separate the heavier heat labile asphaltic materials fraction from the mixture, and (c) effecting the withdrawal of the asphaltic fraction from the centrifuging zone substantially free of the resulting solution of the heptane soluble liquified fuel extract.

2. The method of claim 1 further characterized in that the extract and solvent streams are premixed preior to introduction to the centrifuging zone.

3. The method of claim 2 still further characterized in that the premixing is effected in a static mixer.

4. The method of claim 2 still further characterized in that the premixing is effected in a vertical column providing a presettlement and withdrawal of heavy asphaltic materials from the bottom thereof and an overhead discharge of the lighter asphaltic components with the solvent to be carried to the centrifuging zone.

5. The method of claim 1 further characterized in that the mixture of solvent and soluble residue from the centrifuging zone is subjected to suitable fractionation at suitable conditions to obtain a solvent fraction and a fraction substantially free of heat labile asphaltic materials and at least a portion of the solvent fraction is recycled to combine with the extract charge stream ahead of the centrifuging zone.

6. The method of claim 1 further characterized in that the pressurized centrifugal action in maintaining said solvent material in a liquid state while at an elevated temperature of up to about 200° C. may in turn be maintained up to the order of 10 atmospheres of pressure to thereby reduce the heptane solubles content of the asphaltic fraction.

* * * * *